US010431150B2

(12) United States Patent
Lin et al.

(10) Patent No.: US 10,431,150 B2
(45) Date of Patent: Oct. 1, 2019

(54) DISPLAY DEVICE, LIGHT-EMITTING CONTROL SIGNAL GENERATING DEVICE AND METHOD

(71) Applicant: EverDisplay Optronics (Shanghai) Limited, Shanghai (CN)

(72) Inventors: Yuh-Wey Lin, Shanghai (CN); Qiaoyu Pan, Shanghai (CN); Yen-Jen Lai, Shanghai (CN); Ying-Hsiang Tseng, Shanghai (CN); Jiangang Wang, Shanghai (CN)

(73) Assignee: EverDisplay Optronics (Shanghai) Limited, Shanghai (CN)

( * ) Notice: Subject to any disclaimer, the term of this patent is extended or adjusted under 35 U.S.C. 154(b) by 0 days.

(21) Appl. No.: 15/986,276

(22) Filed: May 22, 2018

(65) Prior Publication Data

US 2018/0350298 A1 Dec. 6, 2018

(30) Foreign Application Priority Data

Jun. 2, 2017 (CN) ..... 2017 1 0408616

(51) Int. Cl.
*G09G 3/3208* (2016.01)
*G09G 3/3266* (2016.01)

(52) U.S. Cl.
CPC ..... *G09G 3/3208* (2013.01); *G09G 3/3266* (2013.01); *G09G 2300/0861* (2013.01); *G09G 2310/0291* (2013.01); *G09G 2310/0297* (2013.01); *G09G 2320/0252* (2013.01); *G09G 2330/025* (2013.01)

(58) Field of Classification Search
CPC ..... G09G 3/3208; G09G 3/3266; G09G 2320/0252; G09G 2300/0861; G09G 2330/025; G09G 2310/0291; G09G 2310/0297
See application file for complete search history.

(56) References Cited

U.S. PATENT DOCUMENTS

2013/0113775 A1* 5/2013 Seo ..... G09G 3/3208 345/211
2016/0155380 A1* 6/2016 Kwon ..... G09G 3/3233 345/78

* cited by examiner

*Primary Examiner* — Abhishek Sarma
(74) *Attorney, Agent, or Firm* — Yunling Ren

(57) ABSTRACT

The present disclosure relates to a display device, a light-emitting control signal generating device and method. The generation device includes: a two-to-two multiplexer, configured to select the first input signal to be output from a first output terminal of the two-to-two multiplexer according to the first control signal, or select the second input signal to be output from a second output terminal of the two-to-two multiplexer according to the first control signal; a first operational amplifier, configured to receive the first input signal and output a first output signal; a second operational amplifier, configured to receive the second input signal and output a second output signal; and a three-to-one multiplexer, configured to receive the first output signal, an intermediate signal and the second output signal, and select one of them to be output as a light-emitting control signal according to a second control signal.

16 Claims, 15 Drawing Sheets

DISPLAY DEVICE, LIGHT-EMITTING CONTROL SIGNAL GENERATING DEVICE AND METHOD

CROSS REFERENCE TO RELATED APPLICATIONS

The present application is based upon and claims priority to Chinese Patent Application No. 201710408616.6, filed on Jun. 2, 2017, the entire contents of which are incorporated herein by reference.

TECHNICAL FIELD

The present disclosure relates to the field of display technology, and in particular, to a light-emitting control signal generating device, a light-emitting control signal generating method, and a display device using the light-emitting control signal generating device.

BACKGROUND

The VR (Virtual Reality) technology adopts computer simulation to create a three-dimensional virtual world which provides users with simulations for senses of sight, hearing, touch and the like, as if they were personally on the scene. In the process of using the VR equipment, in order to relieve the sense of dizziness, it is necessary to reduce a delay effect of the image output. At the same time, in order to allow the eyes to capture a correct image, it is also necessary to reduce the time from the image output to the completion of an entire image display and a response time from the pixel point receiving a signal to the completion of the display. With the development of the optical technology and semiconductor technology, the OLED (Organic Light-emitting Diode) display has become a mainstream display device due to its advantages of high quality, small size, light weight, thin thickness, low voltage driving and low power consumption. Among them, the AMOLED (Active Matrix Driving OLED) has an extremely short response time and is applied to the VR equipment more and more often.

FIG. 1 is a schematic diagram of a structure of a conventional AMOLED display device, the pixel circuit and the timing sequence of which may be referred to FIG. 2 and FIG. 3. The conventional AMOLED display device at least includes a scan driver, a data driver, and a plurality of pixel units (P11, P12 . . . P21, P22 . . . Pn1, Pn2 . . . Pnm), and each pixel unit includes a plurality of TFT (Thin Film Transistor) switches (M1, M2 and M3) and a capacitor (Cst), and an OLED light-emitting device. Each of the pixel units is at least connected to a scan line (S1, S2, S3 . . . or Sn) and a data line (D1, D2, D3 . . . or Dn). The scan line Scan is used to provide an on or off signal for a TFT which controls writing of a data signal. The data line Data is used to cooperate with the timing sequence of the scan line Scan to write corresponding pixel information. In the AMOLED display device of FIG. 1, since the scanning signals are turned on line by line, the data signals, i.e., the pixel information, will be displayed instantly after being written into. Therefore, the motion blurring phenomenon will occur when a display frequency of an image cannot keep up with a changing frequency of the image, which results in poor user experience.

In order to alleviate the Motion Blurring phenomenon, as shown in FIG. 4 and FIG. 5, at least one light-emitting control signal line is introduced on the basis of the conventional AMOLED display device, and at least one TFT switch controlled by a light-emitting control signal En is added to a light-emitting path of its pixel circuit. The light-emitting control signals En of every pixel unit are connected together, and the light-emitting control signal En may be used to control the light-emitting time of the pixel. For example, as shown in FIG. 6, when the scan signals are turned on line by line, pixel circuits correspondingly write pixel data, i.e., the pixel information. At this time, the light-emitting control signal is turned off, and the display device does not display any content. Referring to FIG. 7, the vertical synchronization of the scanning process is controlled by a vertical synchronization signal Vsync, and the horizontal synchronization of the scanning process is controlled by a horizontal synchronization signal Hsync. When the output of the horizontal synchronization signal Hsync is completed, it indicates that writing of all the pixel information is completed. At this time, the sub-pixels in every rows of the display device are uniformly controlled through the light-emitting control signal En, to perform the light-emitting display according to the written data, so that the display device simultaneously displays the content of the image.

However, when the display device is large, the load of the light-emitting control signal is heavy due to the impedance of the line itself and the overlap between the lines. Besides, an instantaneous current of the light-emitting control signal is large at the moment of the level transition (As shown by the I-En waveform in FIG. 7). Based on this, when the OLED is applied to the VR equipment, the VR technology raises new requirements on the OLED display device, for example, how to generate the light-emitting control signal better.

It should be noted that the information disclosed in the above background section is only for the enhancement of understanding of the background of the present disclosure and therefore can include other information that does not form the prior art that is already known to one of ordinary skill in the art.

SUMMARY

It is an object of the present disclosure to provide a light-emitting control signal generating device, and a display device adopting the light-emitting control signal generating device, and overcome one or more problems caused by limitations and defects of the related art at least to a certain extent.

Other features and advantages of the present disclosure will be apparent from the following detailed description, or may be learned by practice of the present disclosure.

According to a first aspect of the embodiments of the present disclosure, there is provided a light-emitting control signal generating device, including:

a two-to-two multiplexer, configured to receive a first input signal and a second input signal, and select the first input signal to be output from a first output terminal of the two-to-two multiplexer according to the first control signal, or select the second input signal to be output from a second output terminal of the two-to-two multiplexer according to the first control signal;

a first operational amplifier, configured to receive the signal output from the first output terminal of the two-to-two multiplexer and output a first output signal;

a second operational amplifier, configured to receive the signal output from the second output terminal of the two-to-two multiplexer and output a second output signal; and a three-to-one multiplexer, configured to receive the first output signal, an intermediate signal and the second output signal, and select the first output signal, the intermediate signal or the second output signal to be output as a light-emitting control signal according to a second control signal.

In an exemplary embodiment of the present disclosure, the two-to-two multiplexer includes a first input terminal, a first output terminal, a second input terminal and a second output terminal, the first input terminal of the two-to-two multiplexer receives the first input signal, and the second input terminal of the two-to-two multiplexer receives the second input signal;

the first operational amplifier includes an input terminal and an output terminal, the input terminal of the first operational amplifier is connected to the first output terminal of the two-to-two multiplexer;

the second operational amplifier includes an input terminal and an output terminal, the input terminal of the two-to-two operational amplifier is connected to the second output terminal of the two-to-two multiplexer; and the three-to-one multiplexer includes a first input terminal, a second input terminal, a third input terminal and an output terminal, the first input terminal of the three-to-one multiplexer is connected to the output terminal of first operational amplifier, the second input terminal of the three-to-one multiplexer is configured to receive the intermediate signal, the third input terminal of the three-to-one multiplexer is connected to the output terminal of the second operational amplifier, and the output terminal of the three-to-one multiplexer is configured to output the light-emitting control signal.

In an exemplary embodiment of the present disclosure, the first output signal is a high level signal, the second output signal is a low level signal, and the intermediate signal is a grounding voltage; or the first output signal is a low level signal, the second output signal is a high level signal, and the intermediate signal is a grounding voltage.

In an exemplary embodiment of the present disclosure, the first input signal and the second input signal are of the same type and include an in-phase input signal and an inverted input single of the first operational amplifier.

In an exemplary embodiment of the present disclosure, the light-emitting control signal generating device further includes:

a control chip, configured to provide the first control signal and the second control signal.

In an exemplary embodiment of the present disclosure, the light-emitting control signal generating device further includes:

a DC-DC converter, configured to convert a DC power source to provide a power source for the first operational amplifier and the second operational amplifier.

According to a second aspect of the embodiments of the present disclosure, there is provided a light-emitting control signal generating method, applied to any one of the above light-emitting control signal generating devices, wherein the method includes:

selecting the first input signal to be input to the first operational amplifier according to the first control signal, to output the first output signal;

selecting the first output signal to be output according to the second control signal;

selecting the intermediate signal to be output according to the second control signal;

selecting the second input signal to be input to the second operational amplifier according to the first control signal, to output the second output signal; and selecting the second output signal to be output according to the second control signal.

In an exemplary embodiment of the present disclosure, the light-emitting control signal generating method further includes:

selecting the second input signal to be input to the second operational amplifier according to the first control signal, to output the second output signal;

selecting the second output signal to be output according to the second control signal;

selecting the intermediate signal to be output according to the second control signal;

selecting the first input signal to be input to the first operational amplifier according to the first control signal, to output the first output signal; and selecting the first output signal to be output according to the second control signal.

According to a third aspect of the embodiments of the present disclosure, there is provided a display device, including any one of the above light-emitting control signal generating devices.

In an exemplary embodiment of the present disclosure, the display device is a virtual reality display device, and the virtual reality display device includes:

a first display module, configured to provide a left-eye image according to a light-emitting control signal provided by the light-emitting control signal generating device; and a second display module, configured to provide a right-eye image according to a light-emitting control signal provided by the light-emitting control signal generating device.

In the technical solution in an embodiment of the present disclosure, a display device is provided with a light-emitting control signal by providing a two-to-two multiplexer, a third-to-one multiplexer, a first operational amplifier and a second operational amplifier. Compared with a light-emitting control signal generating device in the prior art, in the disclosure, the structure is simpler and the space occupation is less. Therefore, the cost of the display device may be further reduced and the overall light weight and thinness may be achieved.

It is to be understood that both the foregoing general description and the following detailed description are exemplary and explanatory only and are not restrictive to the present disclosure.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure. Apparently, the accompanying drawings in the following description show merely some embodiments of the present disclosure, and persons of ordinary skill in the art may still derive other drawings from these accompanying drawings without creative efforts.

DETAILED DESCRIPTION

Figure 1:
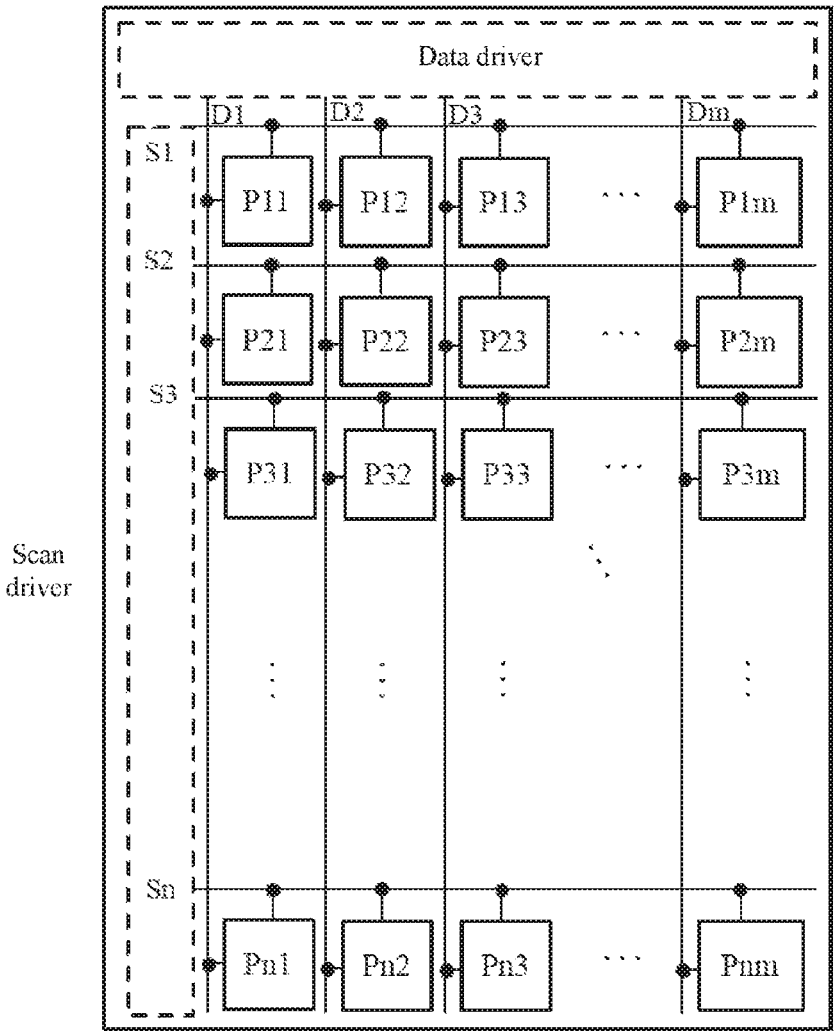
Fig.1 (Prior Art)
FIG. 1 is a schematic diagram of a structure of a display device in prior art.
Figure 2:
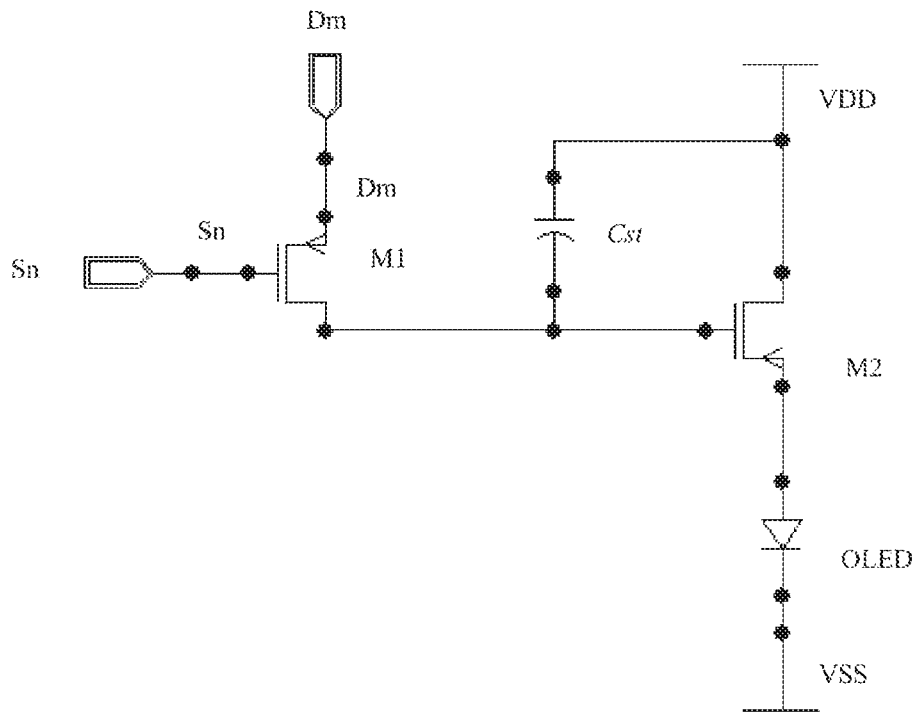
Fig. 2 (Prior art)
FIG. 2 is a pixel circuit diagram of a display device in prior art.
Figure 3:
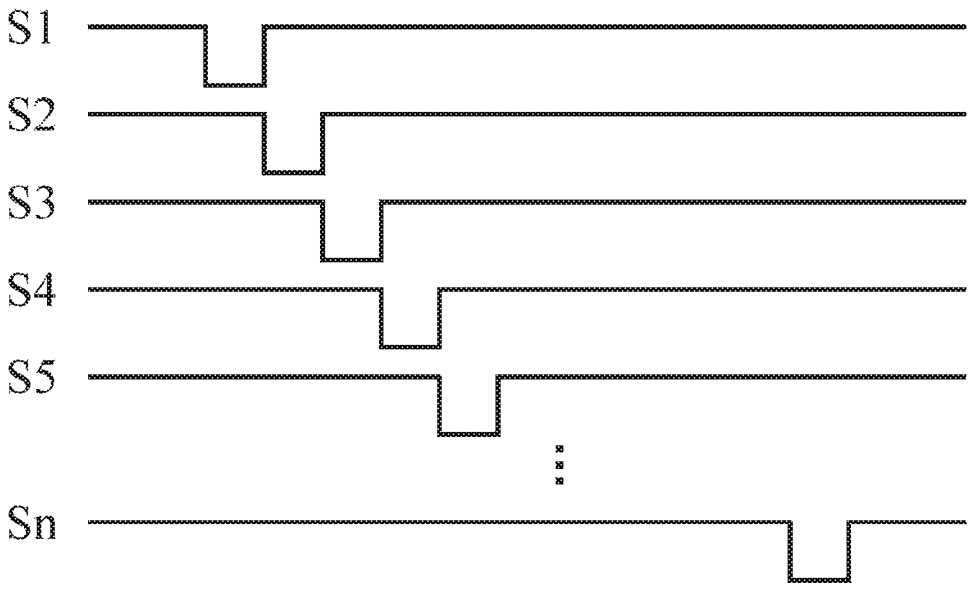
Fig. 3 (Prior art)
FIG. 3 is a signal timing diagram of a display device in prior art.
Figure 4:
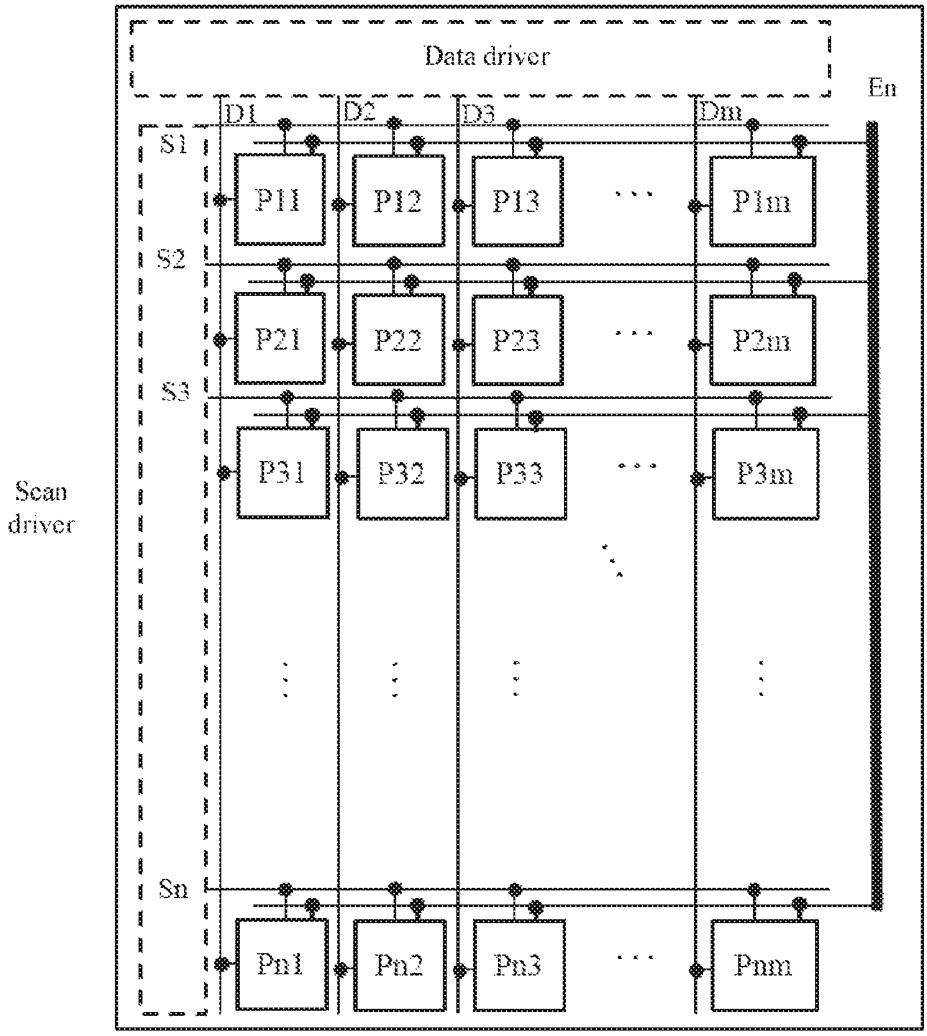
Fig. 4 (Prior art)
FIG. 4 is another schematic diagram of a structure of a display device in prior art.
Figure 5:
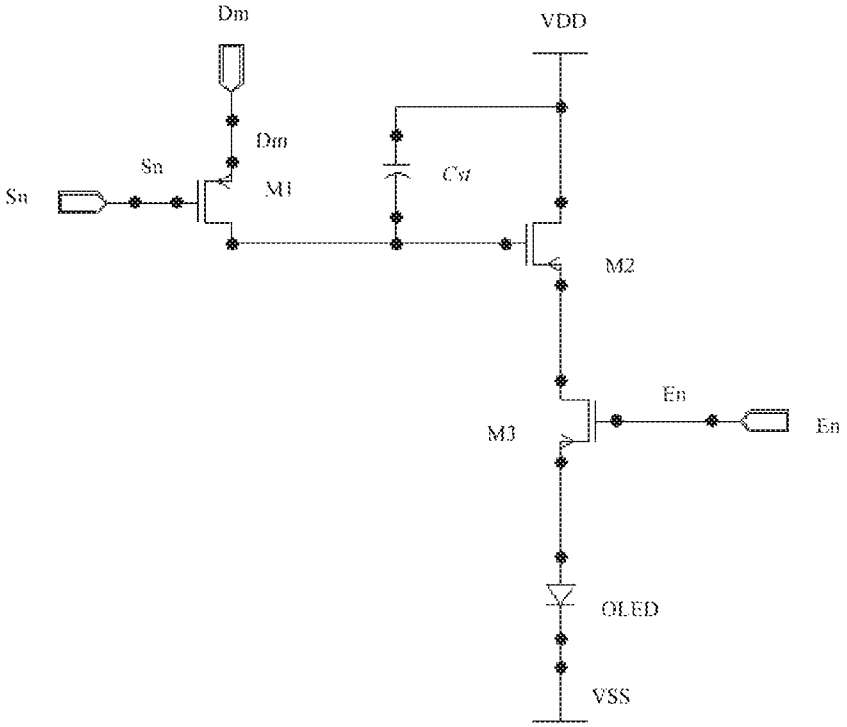
Fig. 5 (Prior art)
FIG. 5 is another pixel circuit diagram of a display device in prior art.
Figure 6:
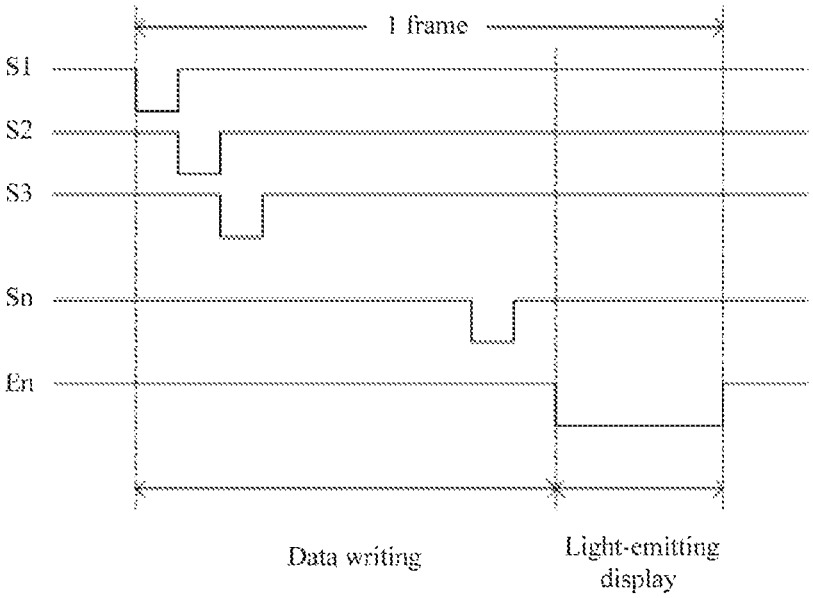
Fig. 6 (Prior art)
FIG. 6 and FIG. 7 are another signal tuning diagrams of a display device in prior art.
Figure 7:
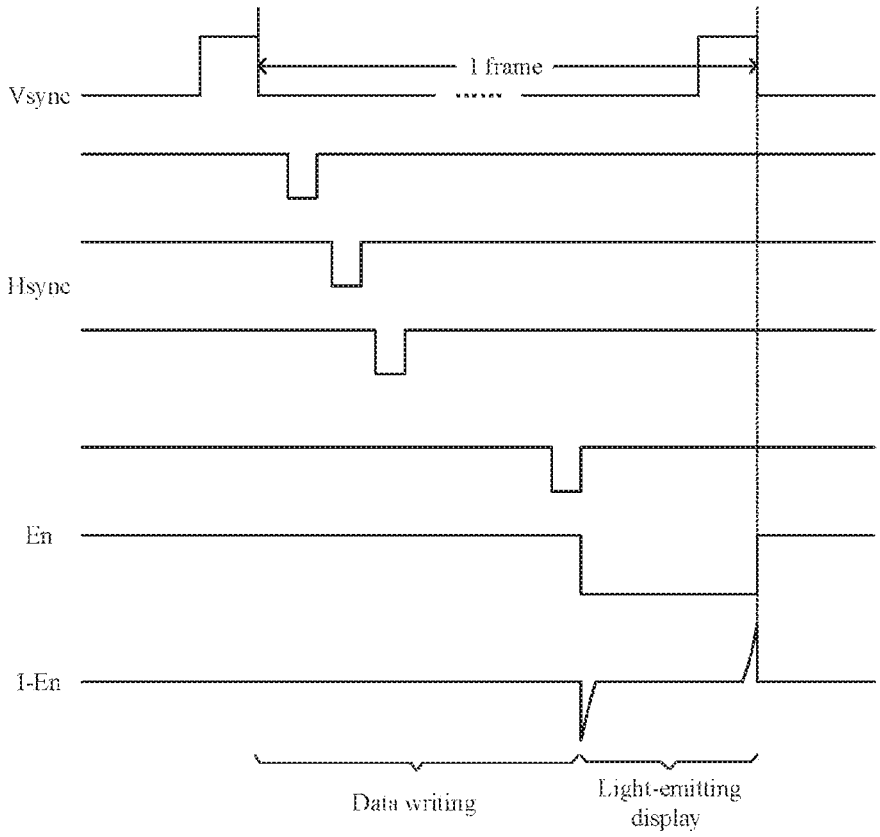
Fig.7 (Prior Art )

Example embodiments will now be described more fully with reference to the accompanying drawings. However, the example embodiments may be embodied in many forms and should not be construed as limited to the embodiments set forth herein: rather these embodiments are provided so that the present disclosure will be thorough and complete, and will fully convey the concepts of the example embodiments to those skilled in the art. In the drawings, the same reference numeral denotes the same or similar structures, and thus the detailed description thereof will be omitted.

In addition, the features, structures, or characteristics described herein may be combined in any suitable manner in one or more embodiments. In the following description, numerous specific details are given to provide a thorough understanding of embodiments of the present disclosure. However, those skilled in the art will recognize that the technical solutions of the present disclosure may be practiced without one or more of the specific details, or may adopt other components, steps, and the like. In other instances, well-known structures are not shown or described in detail to avoid obscuring aspects of the present disclosure.

Figure 8:
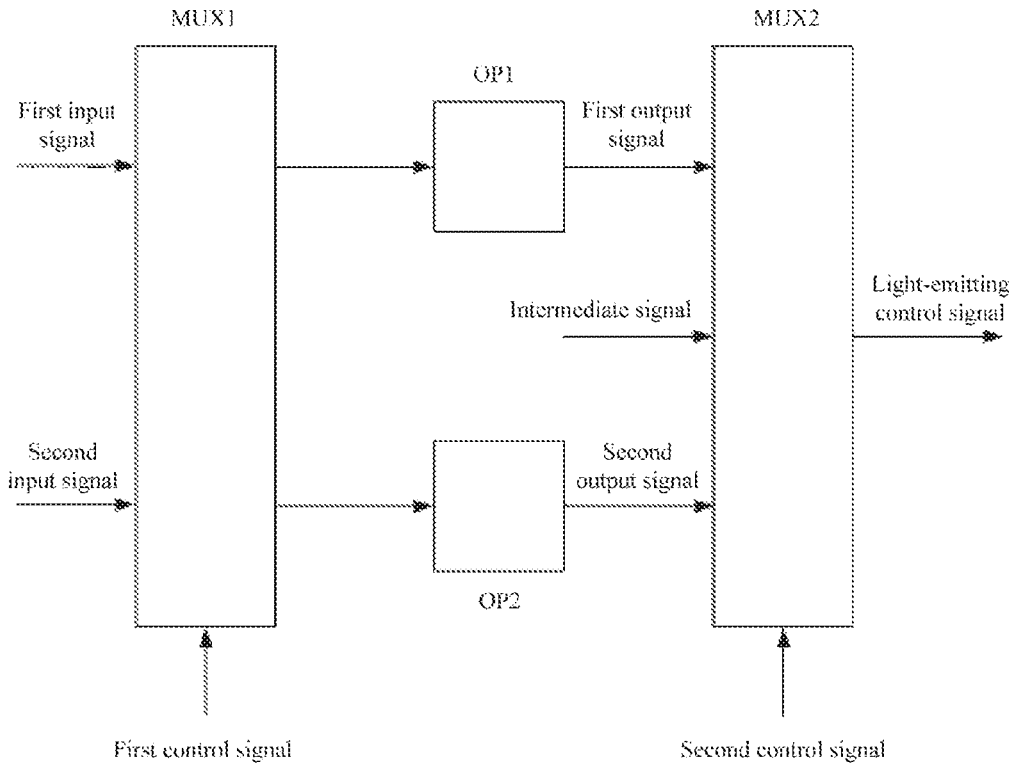
FIG. 8 is a schematic diagram of a structure of a light-emitting control signal generating device in an exemplary embodiment of the present disclosure.

First, a light-emitting control signal generating device is provided in this example embodiment. Referring to FIG. 8, the light-emitting control signal generating device may include: a two-to-two multiplexer MUX1, a first operational amplifier OP1, a second operational amplifier OP2 and a three-to-one multiplexer MUX2.

In the embodiment, the two-to-two multiplexer MUX1 may be configured to receive a first input signal and a second input signal, and select the first input signal to be output from a first output terminal of the two-to-two multiplexer MUX1 according to the first control signal, or select the second input signal to be output from a second output terminal of the two-to-two multiplexer MUX1 according to the first control signal. The first operational amplifier OP1 may be configured to receive the signal output from the first output terminal of the two-to-two multiplexer MUX1 and output a first output signal. The second operational amplifier OP2 may be configured to receive the signal output from the second output terminal of the two-to-two multiplexer MUX1 and output a second output signal. The three-to-one multiplexer MUX2 may be configured to receive the first output signal, an intermediate signal and the second output signal, and select the first output signal, the intermediate signal or the second output signal to be output as a light-emitting control signal En according to a second control signal.

In the following, the above light-emitting control signal generating device in the present exemplary embodiment will be described in more detail with reference to FIG. 9.

Figure 9:
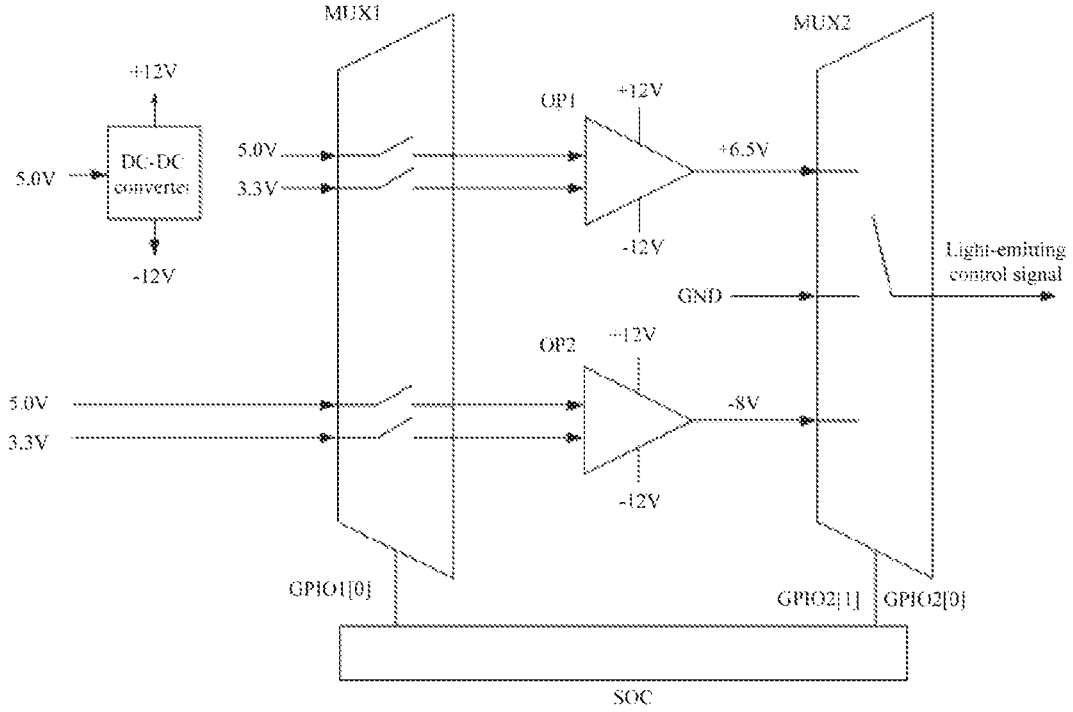
FIG. 9 is a schematic diagram of a structure of a light-emitting control signal generating device in an exemplary embodiment of the present disclosure.

Referring to FIG. 9, the two-to-two multiplexer MUX1 includes a first input terminal, a first output terminal, a second input terminal and a second output terminal. The first input terminal of the two-to-two multiplexer MUX1 receives the first input signal, and the second input terminal of the two-to-two multiplexer MUX1 receives the second input signal. According to different first operational amplifier OP1 and second operational amplifier OP2, corresponding first input signal and second input signal may be adopted. In this example embodiment, the first input signal includes an in-phase input signal and an inverted input single of the first operational amplifier OP1, and the second input signal includes an in-phase input signal and an inverted input single of the second operational amplifier OP2. In order to reduce the number of input signals, in this example embodiment, the first input signal and the second input signal may be of the same type. For example, as shown in FIG. 9, both the first input signal and the second input signal may include signals of 5V and 3.3V. However, it will be easily understood by those skilled in the art that first input signals and second input signals of other types also belong to the protection scope of the present disclosure. The two-to-two multiplexer MUX1 may be a digital switch multiplexer, and may be an analog switch multiplexer, which is not specifically limited in this exemplary embodiment.

Further to refer to FIG. 9, the first operational amplifier OP1 includes an input terminal and an output terminal, the input terminal of the first operational amplifier OP1 is connected to the first output terminal of the two-to-two multiplexer MUX1. The second operational amplifier OP2 includes an input terminal and an output terminal, the input terminal of the two-to-two operational amplifier OP2 is connected to the second output terminal of the two-to-two multiplexer MUX1. In this example embodiment, the first output signal may be a high level signal, for example, the first operational amplifier OP1 may output a signal of +6.5V according to input signals of 5V and 3.3V and the second output signal may be a low level signal, for example, the second operational amplifier OP2 may output a signal of −8V according to the input signals of 5V and 3.3V. In other exemplary embodiments of the present disclosure, it is also possible that the first output signal is a low level signal and the second output signal is a high level signal. In other exemplary embodiments of the present disclosure, voltages of the first output signal and the second output signal may be other values, which are not limited by this example embodiment. The types and parameters of the first operational amplifier OP1 and the second operational amplifier OP2 may be determined by those skilled in the art as desired, which is not specifically limited in this exemplary embodiment.

Figure 10:
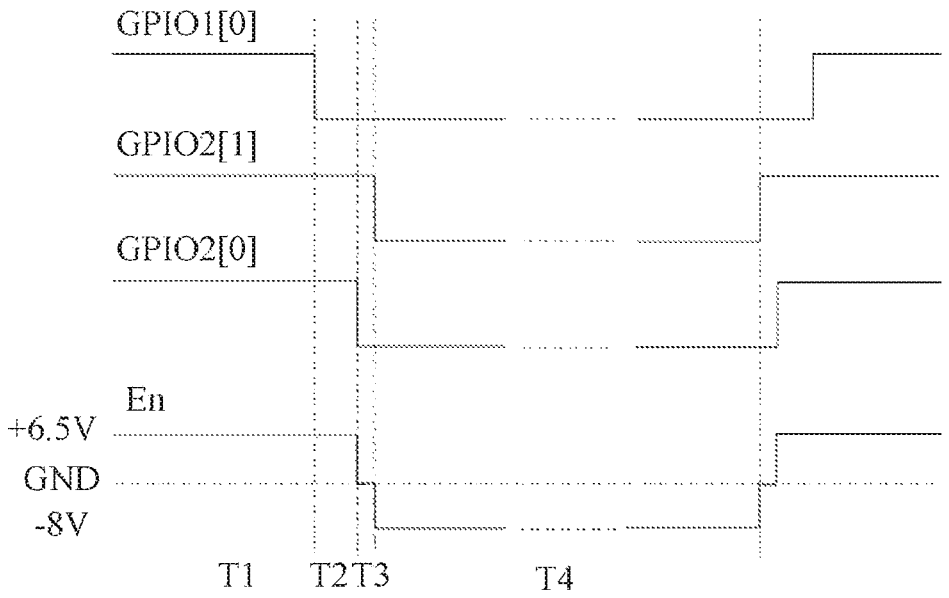
FIG. 10 is a signal timing diagram of a light-emitting control signal generating method in an exemplary embodiment of the present disclosure.

Further to refer to FIG. 9, the three-to-one multiplexer MUX2 includes a first input terminal, a second input terminal, a third input terminal and an output terminal, the first input terminal of the three-to-one multiplexer MUX2 is connected to the output terminal of first operational amplifier OP1, the second input terminal of the three-to-one multiplexer MUX2 is configured to receive the intermediate signal, the third input terminal of the three-to-one multiplexer MUX2 is connected to the output terminal of the second operational amplifier OP2, and the output terminal of the three-to-one multiplexer MUX2 is configured to output the light-emitting control signal En. For example, as shown in FIG. 9, the intermediate signal may be a grounding voltage GND, and signals of +6.5V, 0V or −8V may be selectively output through the three-to-one multiplexer MUX2, to form the light-emitting control signal En as shown in FIG. 10. In the present disclosure, an intermediate signal, such as the grounding voltage GND, is added during the level conversion of the light-emitting control signal En, to reduce the instantaneous peak current caused by the overload of the light-emitting control signal En. It will be easily understood by those skilled in the art that the intermediate signals of other values also belong to the protection scope of the present disclosure. The three-to-one multiplexer MUX2 may be a digital switch multiplexer, or may be an analog switch multiplexer, which is not specifically limited in the present exemplary embodiment.

Further to refer to FIG. 9, in this example embodiment, the light-emitting control signal generating device may further include a control chip. In the embodiment, the control chip may be configured to provide the first control signal and the second control signal. In this example embodiment, the control chip may be, for example, a SOC (System On Chip). A GPIO (General Purpose Input Output) port of the control chip SOC may output a first control signal GPIO1[0] and a second control signal GPIO2[1] and GPIO2[0]. However, in other exemplary embodiments of the present disclosure, for example, the control chip may be a control module of other types, such as a MCU (Microcontroller Unit), which is not specifically limited in this exemplary embodiment.

Further to refer to FIG. 9, in the present example embodiment, the light-emitting control signal generating device may further include a DC-DC converter. In the embodiment, the DC-DC converter may be configured to convert a DC power source to provide a power source for the first operational amplifier OP1 and the second operational amplifier OP2. For example, as shown in FIG. 9, the DC-DC converter may convert a DC power source of 5V into a power source of −12V and +12V, to be supplied to the first operational amplifier OP1 and the second operational amplifier OP2. The selection of the DC-DC converter will be different according to different first operational amplifier OP1 and second operational amplifier OP2, which is not specifically limited in this exemplary embodiment.

Further, the exemplary embodiment further provides a light-emitting control signal generating method, applied to any one of the above light-emitting control signal generating devices. Hereinafter, the light-emitting control signal generating method in this exemplary embodiment will be described with reference to FIGS. 10 to 14.

Figure 11:
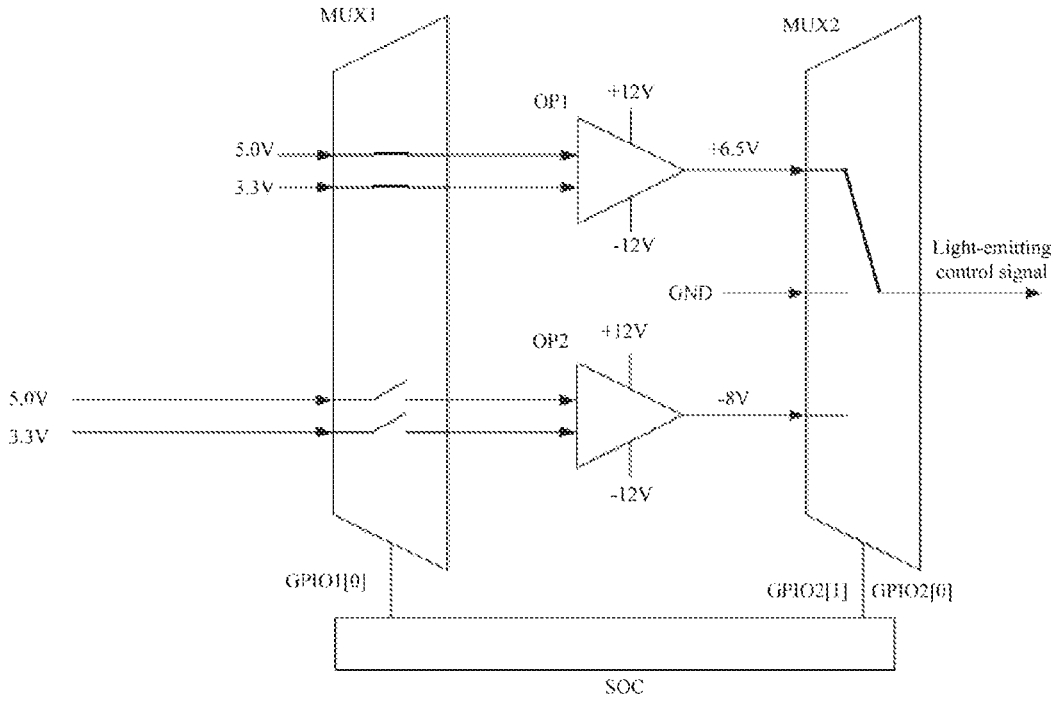
FIG. 11 to FIG. 14 are schematic diagrams of states of a light-emitting control signal generating device in T1 to T4 stages according to an exemplary embodiment of the present disclosure.

Referring to FIG. 10 and FIG. 11, in stage T1, the first control signal GPIO1[0] is a high level. The first control signal GPIO1[0] controls the first input terminal of the two-to-two multiplexer to be conductive with the first output terminal thereof, to input the first input signal to the first operational amplifier OP1. The first operational amplifier OP1 outputs a first output signal of +6.5V according to the signal output from the first output terminal of the two-to-two multiplexer. In the second control signal, GPIO4[1] and GPIO2[0] are both high levels. The second control signal GPIO2[1] and GPIO2[0] controls the first input terminal of the three-to-one multiplexer to be conductive with the output terminal thereof, thus outputting the first output signal of +6.5V, and the light-emitting control signal En is +6.5 V in the stage T1.

Figure 12:
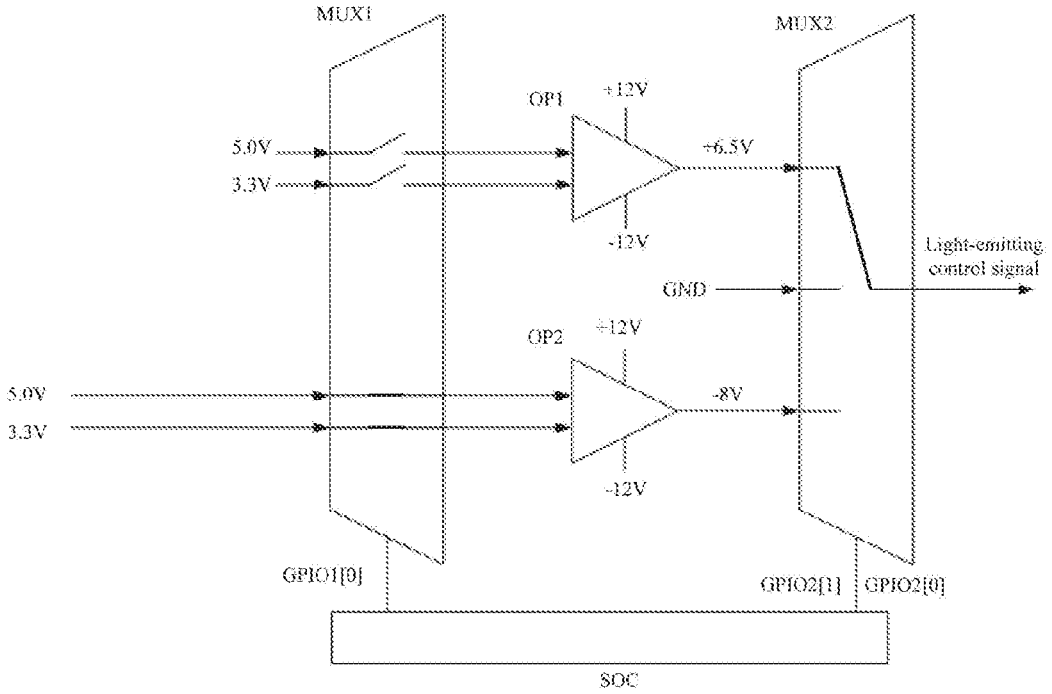

Referring to FIG. 10 and FIG. 12, in stage T2, the first control signal GPIO1[0] is a low level. The first control signal GPIO1[0] controls the second input terminal of the two-to-two multiplexer to be conductive with the second output terminal thereof, to input the second input signal to the second operational amplifier OP2. The second operational amplifier OP2 outputs a second output signal of −8V according to the signal output from the second output terminal of the two-to-two multiplexer. In the second control signal, GPIO2[1] and GPIO2[0] both are still high levels. The second control signal GPIO2[1] and GPIO2[0] controls the first input terminal of the three-to-one multiplexer to be conductive with the output terminal thereof. In the stage T2, the light-emitting control signal generating device does not output the low level of the light-emitting control signal En, and the light-emitting control signal line in the panel is in a floating state.

Figure 13:
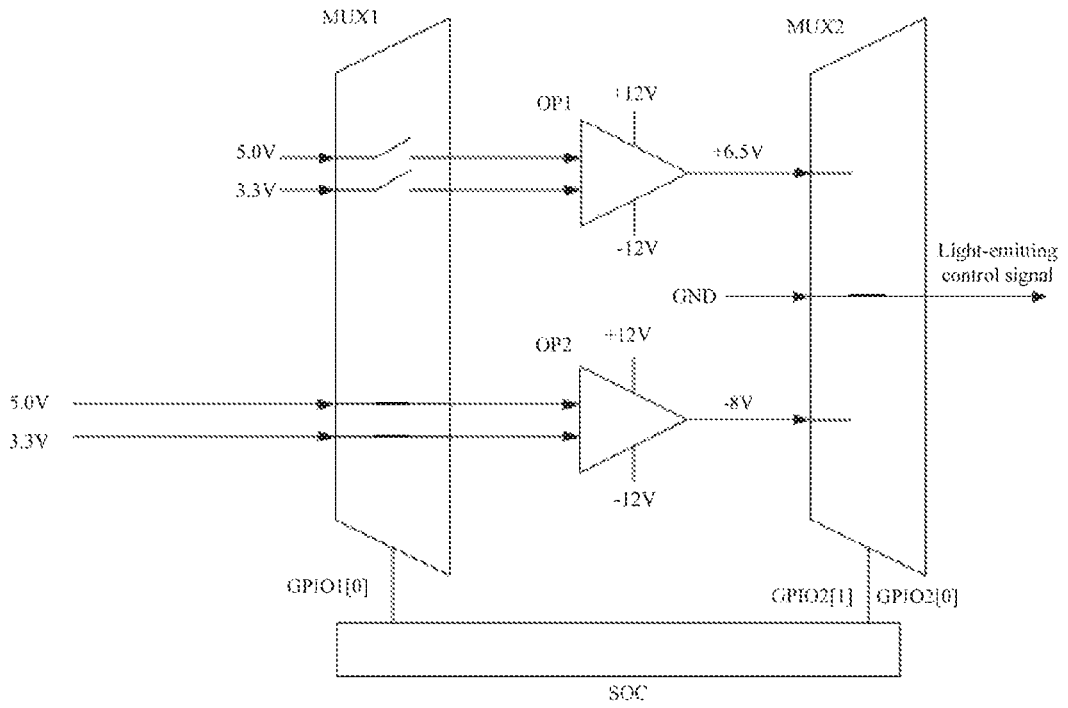

Referring to FIG. 10 and FIG. 13, in stage T3, the first control signal GPIO1[0] is a low level. The first control signal GPIO1[0] controls the second input terminal of the two-to-two multiplexer to be conductive with the second output terminal thereof, to input the second input signal to the second operational amplifier OP2. The second operational amplifier OP2 outputs a second output signal of −8V according to the signal output from the second output terminal of the two-to-two multiplexer. In the second control signal, GPIO2[1] is a high level and GPIO2[0] is a low level. The second control signal GPIO2[1] and GPIO2[0] controls the second input terminal of the three-to-one multiplexer to be conductive with the output terminal thereof, to output the intermediate signal. That is, the light-emitting control signal line inside the panel is grounded. Therefore, the light-emitting control signal En is 0V in the stage T3.

Figure 14:
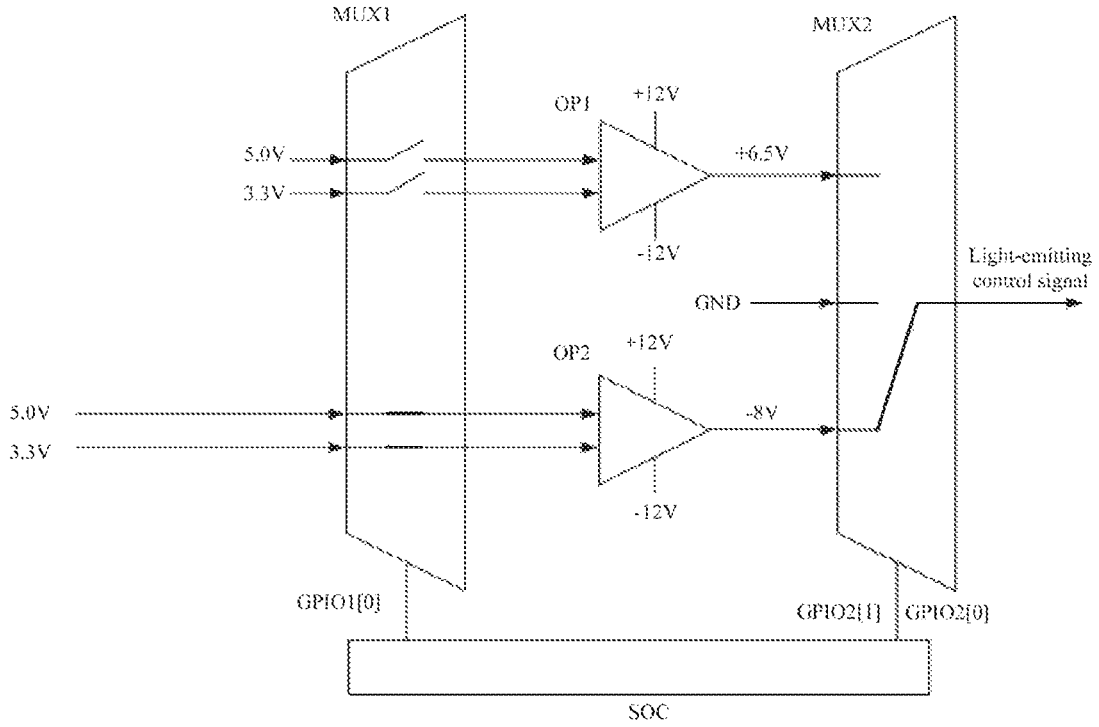

Referring to FIG. 10 and FIG. 14, in a stage T4, the first control signal GPIO1[0] is a low level. The first control signal GPIO1[0] controls the second input terminal of the two-to-two multiplexer to be conductive with the second output terminal thereof, to input the second input signal to the second operational amplifier OP2. The second operational amplifier OP2 outputs a second output signal of −8V according to the signal output from the second output terminal of the two-to-two multiplexer. In the second control signal, GPIO2[1] and GPIO2[0] are both low levels. The second control signal GPIO2[1] and GPIO2[0] controls the third input terminal of the three-to-one multiplexer to be conductive with the output terminal thereof, to output the second output signal of −8V, and the light-emitting control signal En is −8V in the stage T4.

In the present disclosure, an intermediate signal, such as the grounding voltage, is added during the level conversion of the light-emitting control signal En, to reduce the instantaneous peak current caused by the overload of the light-emitting control signal En.

At a rising edge of the light-emitting control signal, the timing sequence of the light-emitting control signal generating method is opposite to that at a falling edge of the light-emitting control signal. For example, the method in that case includes: selecting the second input signal to be input to the second operational amplifier according to the first control signal, to output the second output signal; selecting the second output signal to be output according to the second control signal; selecting the intermediate signal to be output according to the second control signal; selecting the first input signal to be input to the first operational amplifier according to the first control signal, to output the first output signal, and the like. The specific details are similar to the above-mentioned stages T1 to T4, which will not be described herein again.

Figure 15:
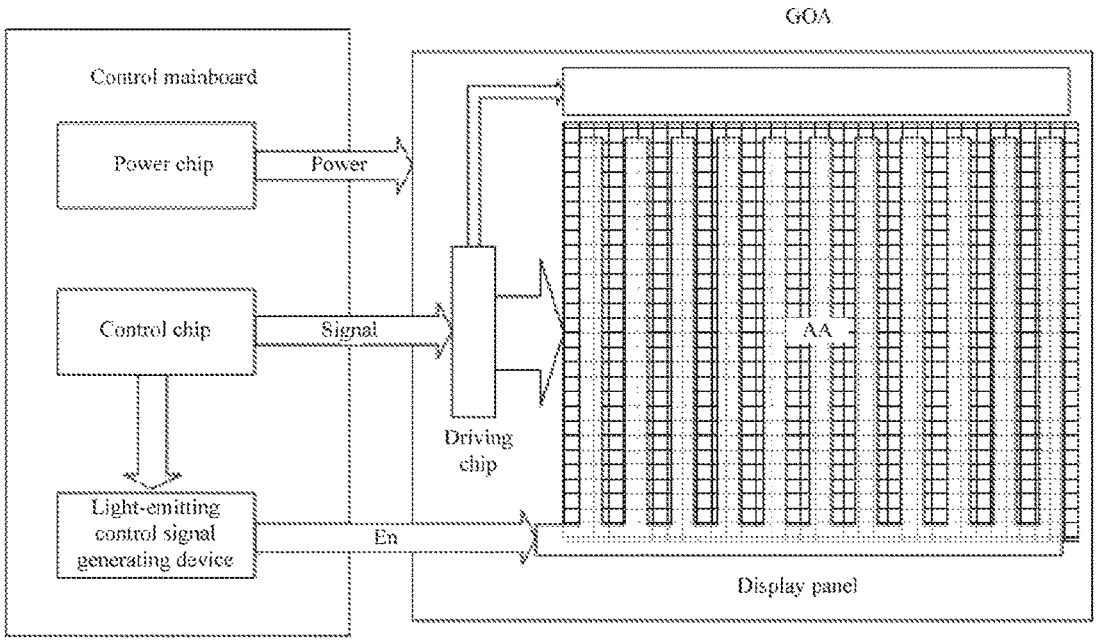
FIG. 15 is a schematic diagram of a structure of a display device in an exemplary embodiment of the present disclosure.

Further, a display device is also provided in this exemplary embodiment. Referring to FIG. 15, the display device in this example embodiment may include a display panel and a control mainboard coupled with the display panel. The display panel includes a pixel matrix AA constituted by sub-pixels arranged in rows and columns, a driving chip Driver 1C, a gate driving circuit GOA, and the like. The control mainboard includes a power chip and the light-emitting control signal generating device described above. The display device may further include a source driver, various types of signal lines, and other parts. In an exemplary embodiment of the present disclosure, the display device may be a virtual reality display device. For example, the virtual reality display device may include a first display module and a second display module. In the embodiment, the first display module includes one display panel described above and may be configured to provide a left-eye image according to a light-emitting control signal provided by the light-emitting control signal generating device. The second display module includes one display panel described above and may be configured to provide a right-eye image according to a light-emitting control signal provided by the light-emitting control signal generating device. Thus, the virtual reality display may be achieved. The display device may be display devices of other types, which is not specifically limited in this exemplary embodiment. The display panel may be an OLED display panel, a liquid crystal display panel, an EPD display panel, or the like, which is not specifically limited in this exemplary embodiment either.

To sum up, in the present exemplary embodiment, a display device is provided with a light-emitting control signal by providing a two-to-two multiplexer, a third-to-one multiplexer, a first operational amplifier and a second operational amplifier. Compared with a light-emitting control signal generating device in the prior art, in the disclosure, the structure is simpler and the space occupation is less. Therefore, the cost of the display device may be further reduced and the overall light weight and thinness may be achieved.

Other embodiments of the present disclosure will readily occur to those skilled in the art upon consideration of the specification and practice of the invention disclosed herein. The present application is intended to cover any variation, use, or adaptive change of the present disclosure that follows general principles of the present disclosure and include common knowledge or conventional technical means in the art which are not disclosed herein. The specification and embodiments are considered as exemplary only, with the true scope and spirit of the present disclosure being indicated by the appending claims.

What is claimed is:

1. A display device, comprising a light-emitting control signal generating device, wherein the light-emitting control signal generating device comprises:

a two-to-two multiplexer, configured to receive a first input signal and a second input signal, and select the first input signal to be output from a first output terminal of the two-to-two multiplexer according to the first control signal, or select the second input signal to be output from a second output terminal of the two-to-two multiplexer according to the first control signal;

a first operational amplifier, configured to receive the signal output from the first output terminal of the two-to-two multiplexer and output a first output signal;

a second operational amplifier, configured to receive the signal output from the second output terminal of the two-to-two multiplexer and output a second output signal; and a three-to-one multiplexer, configured to receive the first output signal, an intermediate signal and the second output signal, and select the first output signal, the intermediate signal or the second output signal to be output as a light-emitting control signal according to a second control signal.

2. The display device according to claim 1, wherein the two-to-two multiplexer comprises a first input terminal, a first output terminal, a second input terminal and a second output terminal, the first input terminal of the two-to-two multiplexer receives the first input signal, and the second input terminal of the two-to-two multiplexer receives the second input signal;

the first operational amplifier comprises an input terminal and an output terminal, the input terminal of the first operational amplifier is connected to the first output terminal of the two-to-two multiplexer;

the second operational amplifier comprises an input terminal and an output terminal, the input terminal of the two-to-two operational amplifier is connected to the second output terminal of the two-to-two multiplexer; and the three-to-one multiplexer comprises a first input terminal, a second input terminal, a third input terminal and an output terminal, the first input terminal of the three-to-one multiplexer is connected to the output terminal of first operational amplifier, the second input terminal of the three-to-one multiplexer is configured to receive the intermediate signal, the third input terminal of the three-to-one multiplexer is connected to the output terminal of the second operational amplifier, and the output terminal of the three-to-one multiplexer is configured to output the light-emitting control signal.

3. The display device according to claim 1, wherein the display device is a virtual reality display device, and the virtual reality display device comprises:

a first display module, configured to provide a left-eye image according to a light-emitting control signal provided by the light-emitting control signal generating device; and a second display module, configured to provide a right-eye image according to a light-emitting control signal provided by the light-emitting control signal generating device.

4. The display device according to claim 2, wherein the display device is a virtual reality display device, and the virtual reality display device comprises:

a first display module, configured to provide a left-eye image according to a light-emitting control signal provided by the light-emitting control signal generating device; and a second display module, configured to provide a right-eye image according to a light-emitting control signal provided by the light-emitting control signal generating device.

5. A light-emitting control signal generating device, comprising:

a two-to-two multiplexer, configured to receive a first input signal and a second input signal, and select the first input signal to be output from a first output terminal of the two-to-two multiplexer according to the first control signal, or select the second input signal to be output from a second output terminal of the two-to-two multiplexer according to the first control signal;

a first operational amplifier, configured to receive the signal output from the first output terminal of the two-to-two multiplexer and output a first output signal;

a second operational amplifier, configured to receive the signal output from the second output terminal of the two-to-two multiplexer and output a second output signal; and a three-to-one multiplexer, configured to receive the first output signal, an intermediate signal and the second output signal, and select the first output signal, the intermediate signal or the second output signal to be output as a light-emitting control signal according to a second control signal.

6. The light-emitting control signal generating device according to claim 5, wherein the two-to-two multiplexer comprises a first input terminal, a first output terminal, a second input terminal and a second output terminal, the first input terminal of the two-to-two multiplexer receives the first input signal, and the second input terminal of the two-to-two multiplexer receives the second input signal;

the first operational amplifier comprises an input terminal and an output terminal, the input terminal of the first operational amplifier is connected to the first output terminal of the two-to-two multiplexer;

the second operational amplifier comprises an input terminal and an output terminal, the input terminal of the two-to-two operational amplifier is connected to the second output terminal of the two-to-two multiplexer; and the three-to-one multiplexer comprises a first input terminal, a second input terminal, a third input terminal and an output terminal, the first input terminal of the three-to-one multiplexer is connected to the output terminal of first operational amplifier, the second input terminal of the three-to-one multiplexer is configured to receive the intermediate signal, the third input terminal of the three-to-one multiplexer is connected to the output terminal of the second operational amplifier, and the output terminal of the three-to-one multiplexer is configured to output the light-emitting control signal.

7. The light-emitting control signal generating device according to claim 5, wherein the first output signal is a high level signal, the second output signal is a low level signal, and the intermediate signal is a grounding voltage; or the first output signal is a low level signal, the second output signal is a high level signal, and the intermediate signal is a grounding voltage.

8. The light-emitting control signal generating device according to claim 6, wherein the first output signal is a high level signal, the second output signal is a low level signal, and the intermediate signal is a grounding voltage; or the first output signal is a low level signal, the second output signal is a high level signal, and the intermediate signal is a grounding voltage.

9. The light-emitting control signal generating device according to claim 5, wherein the first input signal and the second input signal are of the same type and comprise an in-phase input signal and an inverted input single of the first operational amplifier.

10. The light-emitting control signal generating device according to claim 6, wherein the first input signal and the second input signal are of the same type and comprise an in-phase input signal and an inverted input single of the first operational amplifier.

11. The light-emitting control signal generating device according to claim 5, wherein the light-emitting control signal generating device further comprises:

a control chip, configured to provide the first control signal and the second control signal.

12. The light-emitting control signal generating device according to claim 6, wherein the light-emitting control signal generating device further comprises:

a control chip, configured to provide the first control signal and the second control signal.

13. The light-emitting control signal generating device according to claim 5, wherein the light-emitting control signal generating device further comprises:

a DC-DC converter, configured to convert a DC power source to provide a power source for the first operational amplifier and the second operational amplifier.

14. The light-emitting control signal generating device according to claim 6, wherein the light-emitting control signal generating device further comprises:

a DC-DC converter, configured to convert a DC power source to provide a power source for the first operational amplifier and the second operational amplifier.

15. A light-emitting control signal generating method, applied to the light-emitting control signal generating device according to claim 5, wherein the method comprises:

selecting the first input signal to be input to the first operational amplifier according to the first control signal, to output the first output signal;

selecting the first output signal to be output according to the second control signal;

selecting the intermediate signal to be output according to the second control signal;

selecting the second input signal to be input to the second operational amplifier according to the first control signal, to output the second output signal; and selecting the second output signal to be output according to the second control signal.

16. The light-emitting control signal generating method according to claim 15, wherein the light-emitting control signal generating method further comprises:

selecting the second input signal to be input to the second operational amplifier according to the first control signal, to output the second output signal;

selecting the second output signal to be output according to the second control signal;

selecting the intermediate signal to be output according to the second control signal;

selecting the first input signal to be input to the first operational amplifier according to the first control signal, to output the first output signal; and selecting the first output signal to be output according to the second control signal.

* * * * *